United States Patent [19]

Brisson

[11] 4,201,508

[45] May 6, 1980

[54] PLATEN SLIDE COVER FOR REFUSE HANDLING SYSTEMS

[75] Inventor: John R. Brisson, Kingsford, Mich.

[73] Assignee: Lodal, Inc., Kingsford, Mich.

[21] Appl. No.: 905,163

[22] Filed: May 12, 1978

[51] Int. Cl.[2] ..... B65F 3/00

[52] U.S. Cl. ..... 414/525 R; 100/190

[58] Field of Search ..... 414/407, 517, 519, 525; 100/190

[56] References Cited

U.S. PATENT DOCUMENTS

| | | | |
|---|---|---|---|
| 3,252,600 | 5/1966 | Brisson et al. | 414/525 X |
| 3,621,774 | 11/1971 | Dedio et al. | 100/190 X |
| 3,908,540 | 9/1975 | Broman | 100/190 |
| 3,955,694 | 5/1976 | Herpich | 401/525 X |

*Primary Examiner*—Robert G. Sheridan

*Attorney, Agent, or Firm*—Andrus, Sceales, Starke & Sawall

[57] ABSTRACT

A refuse collection vehicle has a hopper and a compacting platen. A slide cover is disposed behind the platen and automatically moves rearwardly and forwardly therewith when the platen is short stroking or otherwise moving in at least a portion of the hopper area. The slide cover and platen move together as a unit at all times in this situation. When the platen is moved rearwardly in a full stroke during a compaction cycle, the platen and slide cover are automatically disengaged at a selected point in the stroke to permit the platen to freely proceed rearwardly. Upon retraction of the platen, it and the slide cover automatically re-engage.

14 Claims, 10 Drawing Figures

Fig. 1
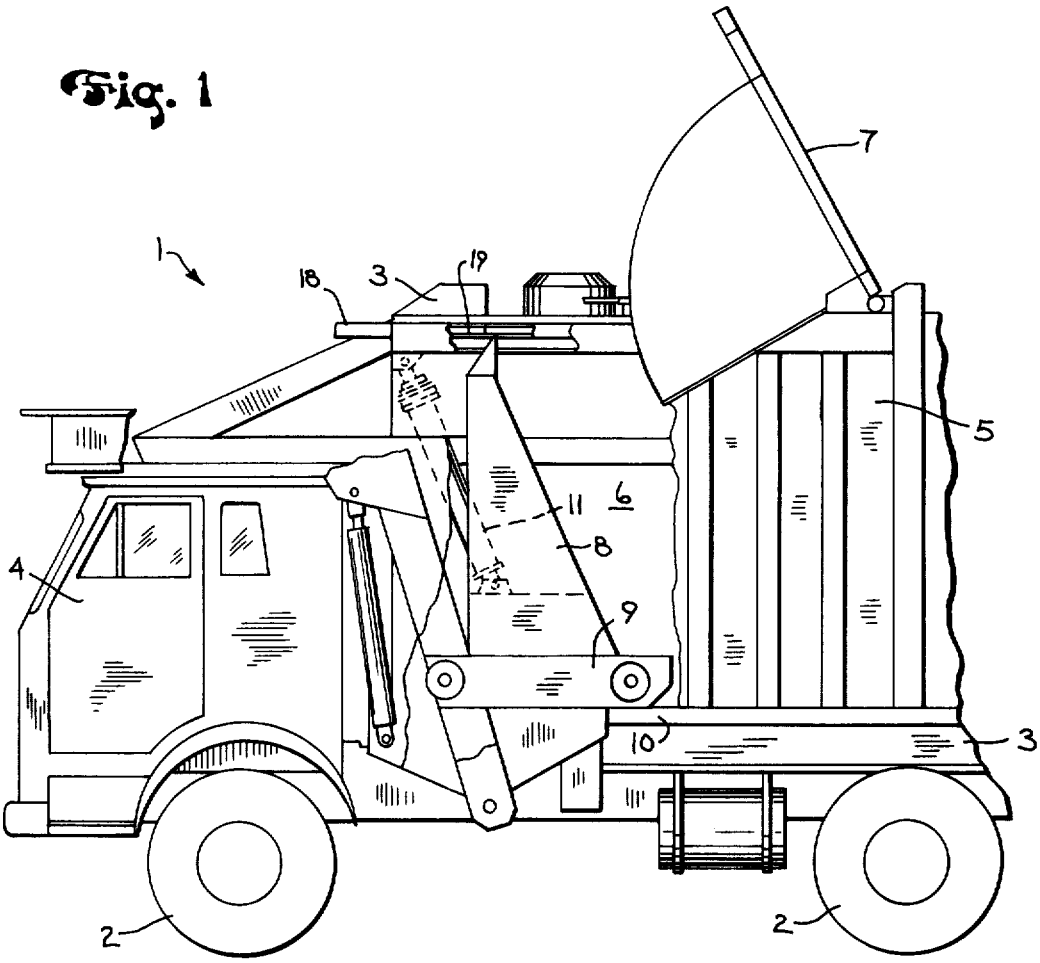
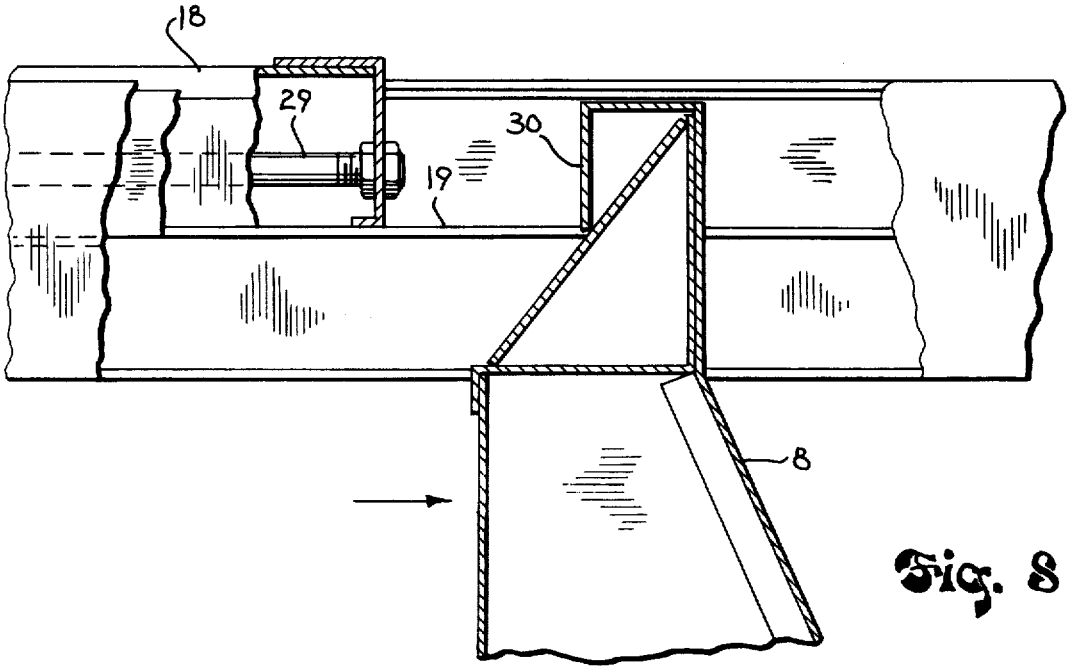
Fig. 8

PLATEN SLIDE COVER FOR REFUSE HANDLING SYSTEMS

PRIOR ART OF INTEREST

U.S. Pat. Nos. 3,252,600 Brisson et al May 24, 1966, 3,870,174 Brisson Mar. 11, 1975.

BACKGROUND AND SUMMARY OF THE INVENTION

This invention relates to a platen slide cover for refuse handling systems.

Generally, garbage and like refuse is often collected and placed in a large truck-mounted chamber where it is sometimes compacted to provide maximum capacity for the chamber. When the chamber is full, the truck is driven to a dump site or other desired place, the refuse removed, and the empty truck returned to its collection rounds.

Compaction of the refuse is usually accomplished by a platen which is moved rearwardly from the hopper area to push the refuse from the hopper into the rearward storage chamber of the truck.

Sometimes, as when the final load of refuse is to be compacted, or when a load overfills the hopper, rearward platen movement causes the refuse to spill forwardly out of the hopper and over the top of the platen. The platen is often short stroked at such times in an attempt to settle the load so that the hopper cover of the vehicle can be closed. Short stroking is moving the platen back and forth short distances while it is in the hopper area, as contrasted with a unidirectional compacting stroke which carries the platen rearwardly of the hopper area and even into the storage chamber itself.

The present invention is based on a solution to the spillage problem wherein refuse cannot spill forwardly over the platen during short stroking, and yet the platen is automatically not hindered in making a full compaction stroke rearwardly.

In accordance with a broad aspect of the invention, a sliding cover is disposed behind the platen and automatically moves rearwardly and forwardly therewith when the platen is short stroking or otherwise moving in at least a portion of the hopper area. The cover and platen move together as a unit at all times in this situation.

In accordance with a further broad aspect of the invention, when the platen is moved rearwardly in a full stroke during a compaction cycle, the platen and cover are automatically disengaged at a selected point in the stroke to permit the platen to freely proceed rearwardly. Upon retraction of the platen, it and the cover automatically re-engage.

The cover serves to prevent spillage of refuse over the platen.

In accordance with a more specific aspect of the invention, mechanical latch, fluid driven and spring means may be utilized to provide the desired joining and disengagement of the platen and cover.

BRIEF DESCRIPTION OF THE DRAWINGS

The accompanying drawings illustrate the best mode presently contemplated by the inventor for carrying out the invention.

In the drawings:

FIG. 1 is a fragmentary side elevation of a refuse compaction vehicle which incorporates the invention, parts being broken away for purposes of clarity;

FIG. 8 shows the separated platen moving rearwardly in a full compaction stroke in the embodiment of FIGS. 6 and 7;

DESCRIPTION OF THE PREFERRED EMBODIMENTS

Figure 2:
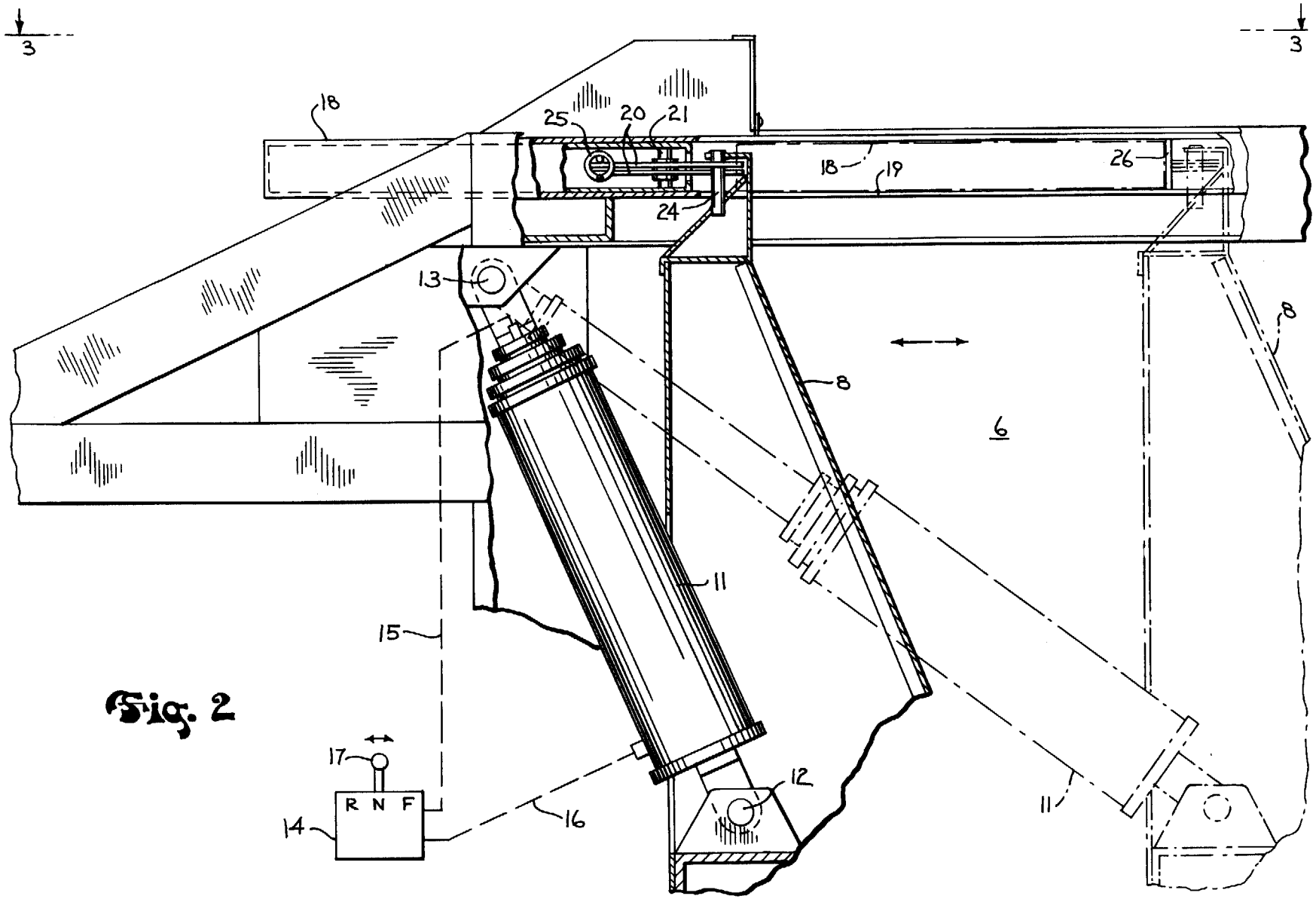
FIG. 2 is an enlarged fragmentary side view of the platen in its retracted and partially extended positions, showing the cover and its mechanical connection to the platen.

As best shown in FIG. 1, the concept of the invention may be utilized in a refuse collection vehicle 1 having the usual wheels 2 which support a frame 3. Frame 3 in turn supports a cab 4 and a refuse storage compartment 5. A hopper area 6 is disposed ahead of compartment 5 and has the usual cover 7 which is pivotally mounted to the roof of compartment 5.

A platen 8 is normally disposed in hopper area 6 and with the platen having a base 9 which is adapted to slide or roll horizontally on a suitable track 10 mounted on frame 3. As best shown in FIG. 2, platen 8 is driven by a motive means such as a compaction cylinder 11 which is mounted at one end on the platen, as at 12, and at the other end to the vehicle framework as at 13. Cylinder 11 is actuated in any suitable well-known manner such as via an operator's control box 14 which selectively provides pressurized fluid through lines 15 and 16 to the cylinder. Box 14 has a handle 17 for shifting the cylinder's operating mode to and between forward, neutral and reverse.

Platen 8 is adapted to move from a forward or retracted position, as shown in full lines in FIGS. 1 and 2, to an intermediate position generally in the rear of hopper area 6 as shown in phantom in FIG. 2, and also to a rearward or fully extended position within compartment 5, this final position not being shown.

In some instances, as previously discussed, it is desired to short stroke platen 8 when it is between its retracted and intermediate positions. This may be done by shifting handle 17 back and forth between the forward and reverse positions.

In accordance with one aspect of the invention, it is desired to prevent refuse from spilling from the hopper and forwardly over the top of the platen during short stroking. Broadly, this is accomplished by providing a horizontal cover 18 which is disposed directly behind platen 8 and which is movable along horizontal tracks 19 on the vehicle framework. Cover 18 is adapted to continuously engage and follow platen 8 during the latter's movement between only retracted and intermediate positions, no matter which direction the platen is moving.

In accordance with another aspect of the invention, means are provided to permit automatic separation of the platen and its associated cover when the platen moves from its intermediate position toward its fully extended position.

More specifically, and in the embodiment of FIGS. 1–5, a mechanical latch device is utilized to accomplish the desired purpose. As shown, cover 18 is provided with a pivotable catch means which comprises a pair of overlapping catch plates 20 which are pivotally mounted to a shaft 21. The outer or rearwardly facing ends of plates 20 are formed with mutually converging edges 22 which merge into opposed curved latch portions 23 which are adapted to receive therebetween a vertical lock pin 24 which extends upwardly from the upper tip portion of platen 8. A pair of springs 25 extend between a portion of cover 18 and the respective catch plates 20 to bias latch portions 23 toward each other and thereby securely lock cover 18 in position directly behind platen 8.

Figure 3:
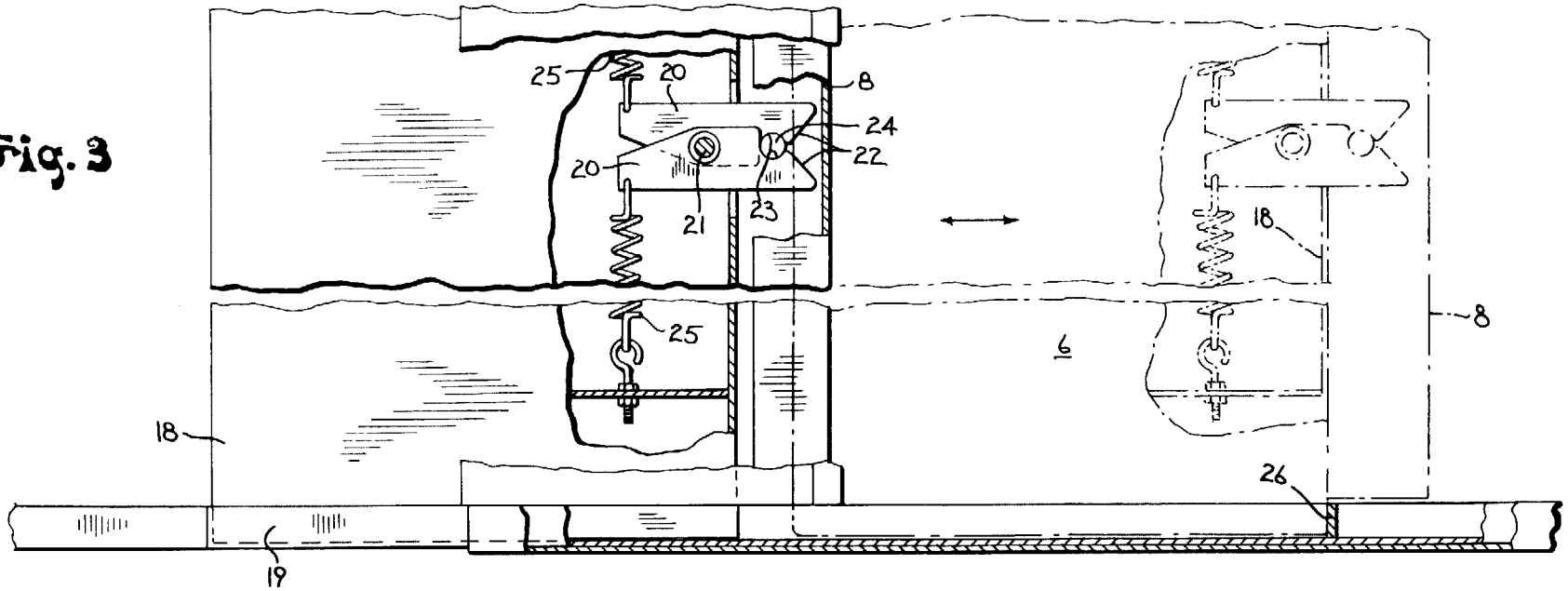
FIG. 3 is a top plan view taken on line 3—3 of FIG. 2.

Referring to FIGS. 2 and 3, when platen 8 is actuated by cylinder 11 and moves between its retracted position shown in full lines and its intermediate position shown in phantom, the latch mechanism holds platen 8 and cover 18 in continuously joined relationship so that cover 18 covers the hopper behind the platen so that no refuse can spill over to behind the platen. Even during back-and-forth short stroking, as per the arrow, cover 18 follows the platen at all times.

Figure 5:
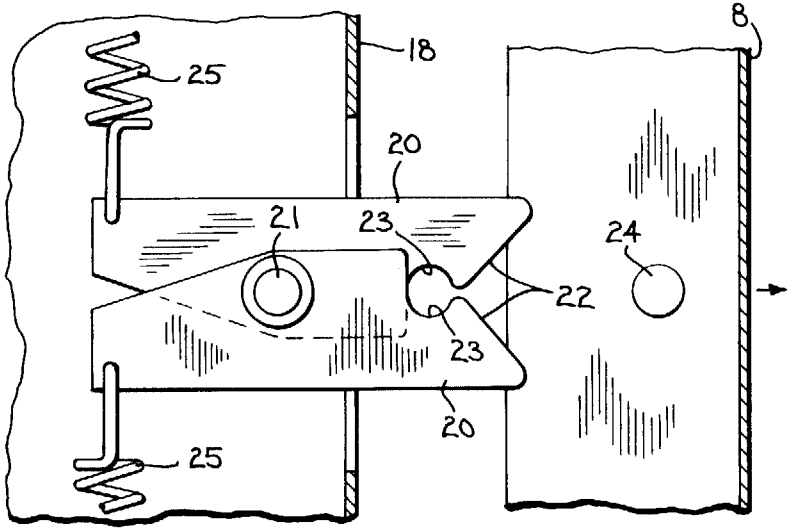
FIG. 5 is a view similar to FIG. 4 after full unlatching has taken place.
Figure 4:
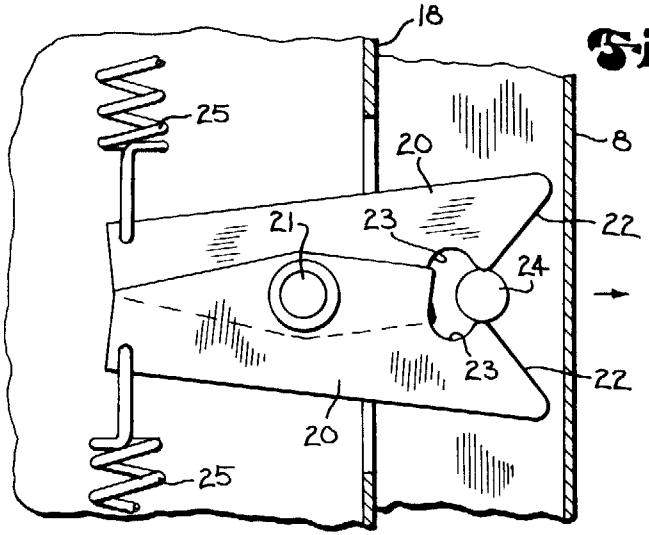
FIG. 4 is a fragmentary view showing the beginning of the automatic mechanical unlatching of the platen from the cover as the platen moves further rearwardly.

It is contemplated that platen 8 performs a compacting function in some instances by traveling beyond its intermediate position to a fully extended position, but that cover 18 does not follow this movement. For this purpose, a stop 26 is disposed on each track 19. When the platen reaches its intermediate position and continues to move rearwardly toward refuse storage compartment 5, stop 26 will be engaged by cover 18, which then cannot proceed further. As shown in FIGS. 4 and 5, as platen 8 continues moving, lock pin 24 pulls out of the latch by overcoming the biasing force of springs 25 and the platen continues onward without the cover. Upon return movement, lock pin 24 will ride over edges 22 and into the latch and the entire assembly will move forwardly as a unit.

Figure 7:
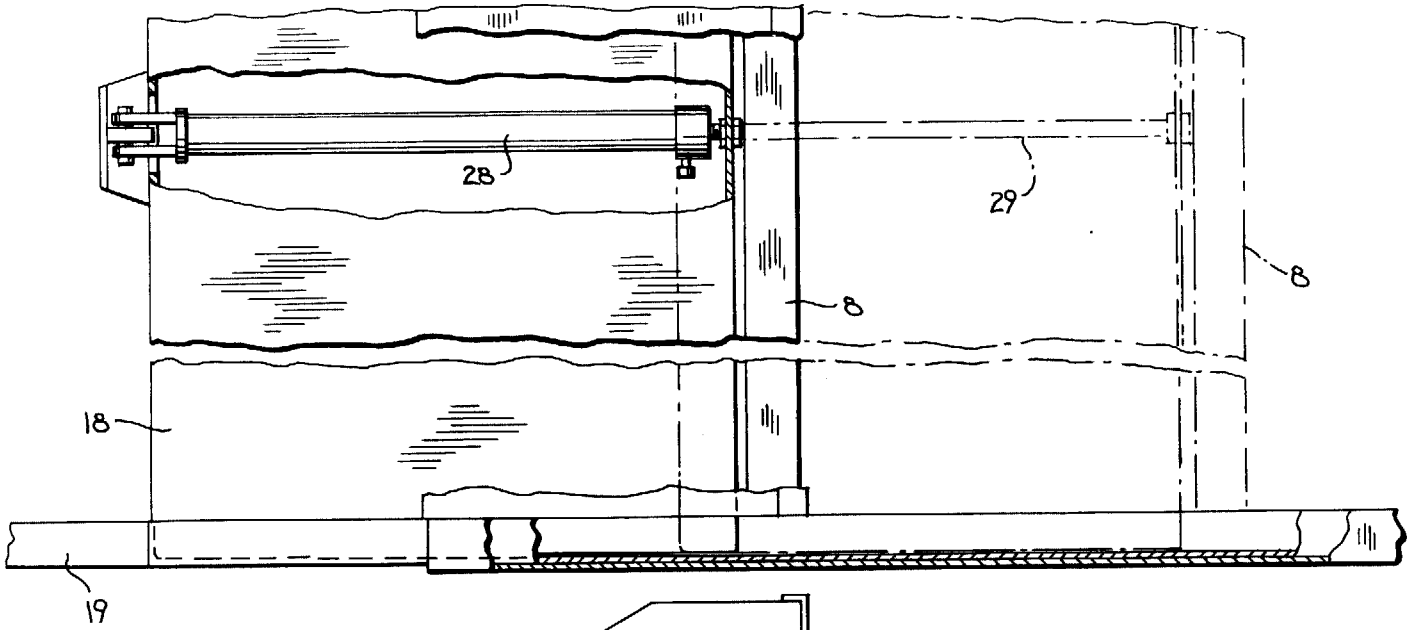
FIGS. 6 and 7 are views similar to FIGS. 2 and 3 wherein a hydraulic embodiment is illustrated.
Figure 6:
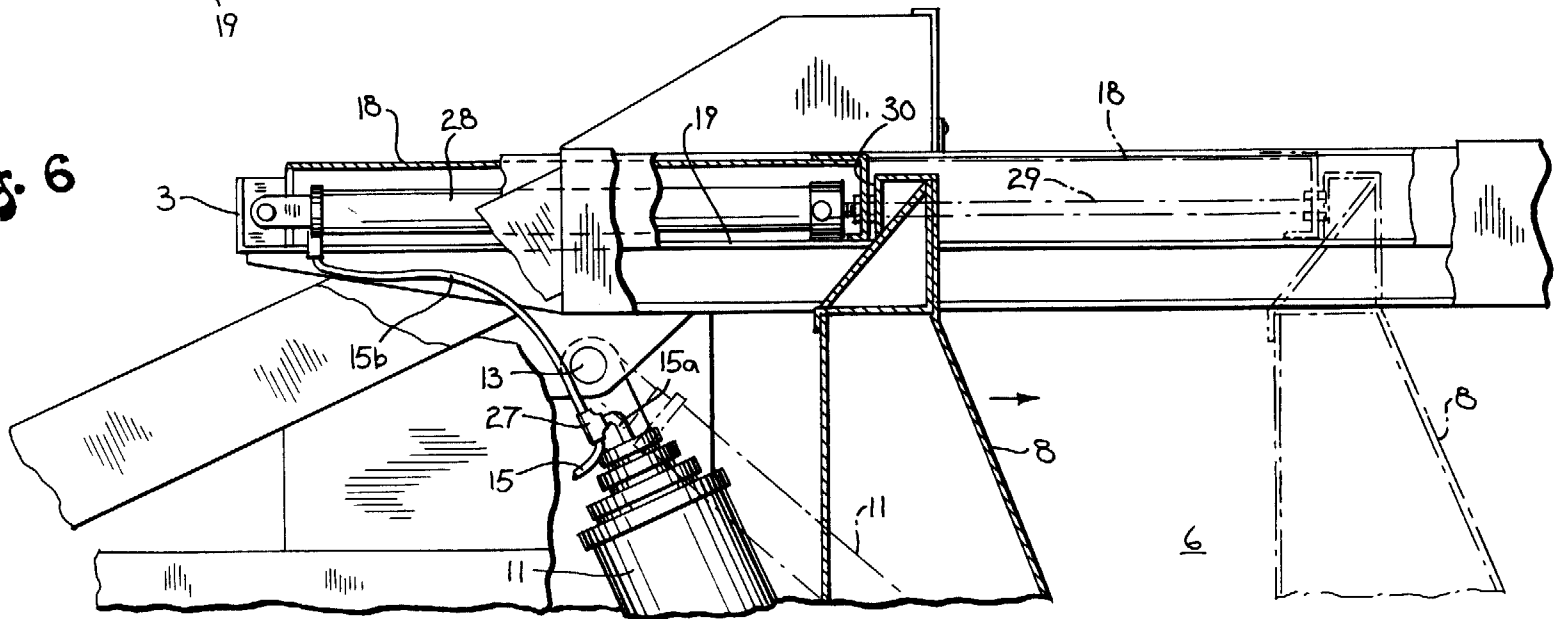

In the embodiment of FIGS. 6–8, a fluid actuated device is utilized. In this instance, hydraulic line 15 is connected through a T connector 27 to both compacting cylinder 11 and a motive means such as a platen slide cover cylinder 28 via lines **15*a* and 15*b*. Cylinder 28 is of the single acting type and is mounted between a portion of the vehicle framework and cover 18. The stroke of cylinder 28 is only equal to the distance between the retracted position (full lines) and intermediate position (phantom lines) of platen 8**.

When platen 8 moves rearwardly, fluid supplied to cylinder 11 also enters cylinder 28 to coordinate the two so that cylinder 28 pushes cover 18 outwardly to follow the platen. When cylinder 11 is actuated to retract the platen, the latter pushes cover 8 back with it. Thus, a short stroking operation with continuous following of cover 18 is also possible in this embodiment.

When platen 8 moves rearwardly beyond its intermediate position and toward its fully extended position, it will exceed the maximum extended stroke of piston 29 of cylinder 28, and thus cover 18, and will move outwardly alone as shown in FIG. 8. Upon return, a contact face 30 on the platen will engage the cover to retract it also.

Figure 9:
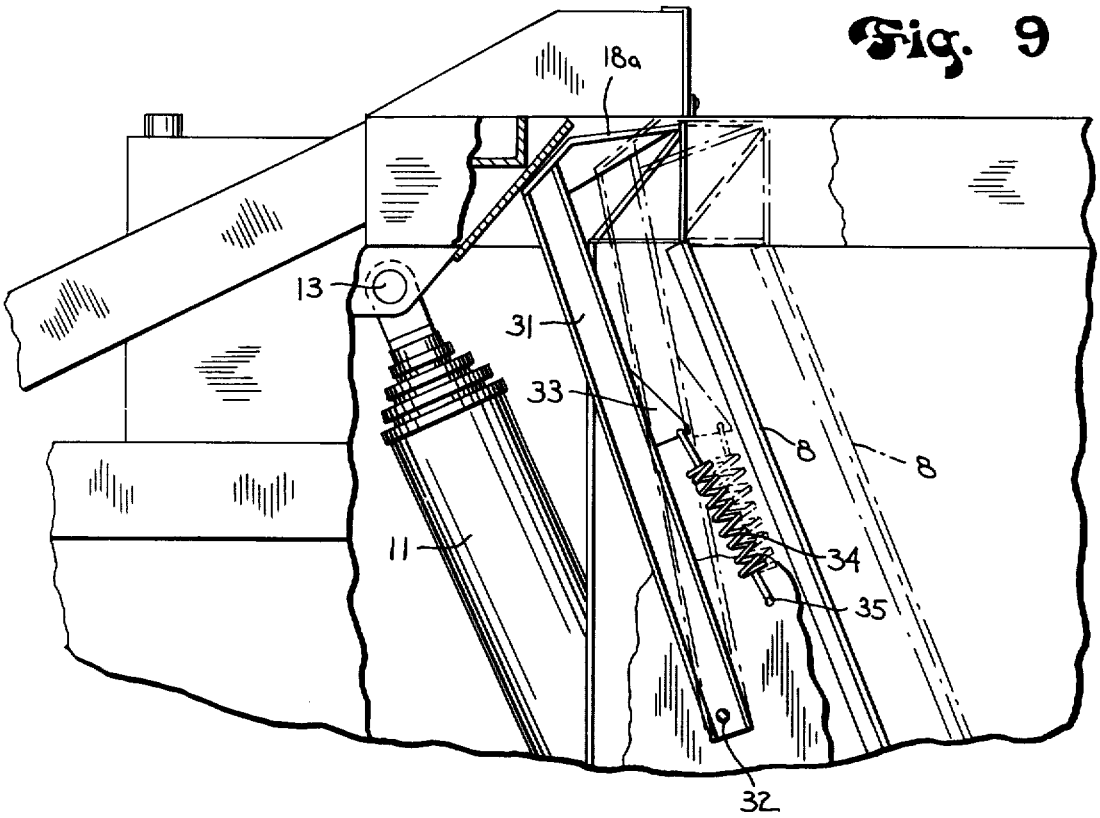
FIG. 9 is a view of a spring actuated embodiment, with two positions of the joined platen and cover shown.
Figure 10:
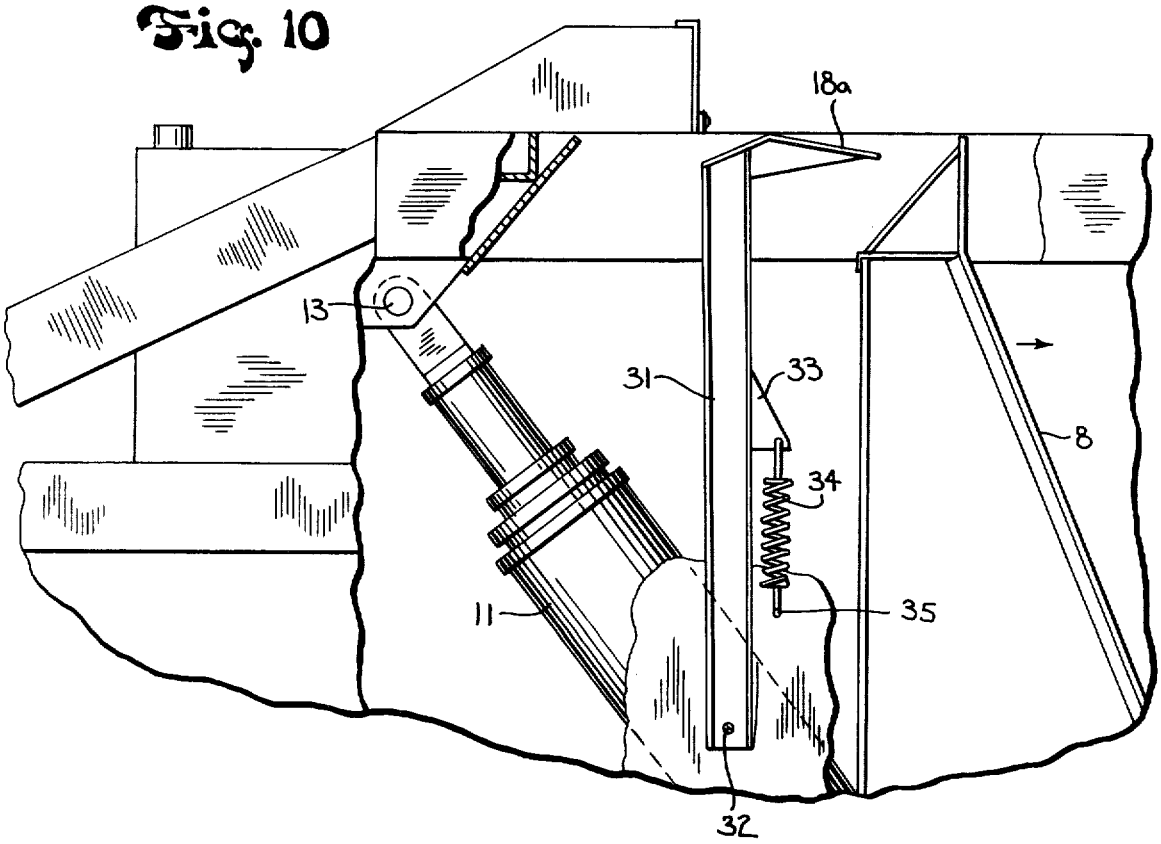
FIG. 10 is a view similar to FIG. 8 and showing the separated platen moving rearwardly in a full compaction stroke in the embodiment of FIG. 9.

In the embodiment of FIGS. 9 and 10, a spring actuated device is utilized to cause the cover to follow the platen. In this instance, cover **18*a* does not slide in a track, but instead comprises a transversely extending roof-shaped member which is supported at each end by an arm 31, the lower end of which is pivotally mounted to the vehicle framework, as at 32. A bracket 33 on each arm 31 is connected to one end of a biasing spring 34, the other end of which is also attached to the vehicle framework, as at 35. The point 35 is below bracket 33 and is horizontally positioned at the aforementioned intermediate position of platen 8**.

When platen 8 is disposed between its retracted and intermediate positions, as shown in FIG. 9, and if cylinder 11 is actuated to move the platen in either direction, spring 34 will cause the pointed end of cover **18*a* to be biased into engagement with the platen and follow it at all times. Note that spring 34** is disposed at an angle to the vertical.

However, and referring to FIG. 10, when platen 8 reaches its intermediate position, spring 34 will be vertically disposed. Since spring 34 cannot make its arm 31 move over center, when platen 8 continues on toward its fully extended position, arm 31 will stop in a generally vertical position and await the return of the platen for subsequent retraction.

The concept of the invention provides an improved structure wherein refuse cannot fall behind the platen when it is operating in the hopper area, such as by short stroking, and yet the platen and protective cover are automatically released and disengaged when full compacting is desired.

Various modes of carrying out the invention are contemplated as being within the scope of the following claims particularly pointing out and distinctly claiming the subject matter which is regarded as the invention.

I claim:

1. In a refuse collection vehicle:

(a) a frame, (b) a hopper on said vehicle, (c) a refuse storage compartment disposed rearwardly of said hopper, (d) a refuse handling platen normally disposed in said hopper and movable between a retracted, an intermediate and a fully extended position, (e) motive means to selectively move said platen between said positions in either a forward or rearward direction, (f) cover means for said hopper and with said cover means being disposed behind said platen, (g) and means to cause said cover means to continuously engage said platen and follow the movement thereof in either a forward or rearward direction when said platen is disposed between its retracted and intermediate positions and to separate from said platen when said platen moves beyond said intermediate position.

2. The refuse collection vehicle of claim 1 wherein said means (g) causes said platen to automatically separate from said cover means when said platen moves from said intermediate toward said fully extended position.

3. The refuse collection vehicle of claim 1 wherein said engagement causing means comprises a latch mechanism disposed between said platen and said cover means, said latch mechanism serving to lock said platen and cover together when said platen is disposed between said retracted and said intermediate positions.

4. The refuse collection vehicle of claim 3 wherein said latch mechanism comprises:

(a) a pair of pivotable catch plates disposed on said cover means and with said catch plates forming opposing curved latch portions, (b) a lock pin disposed on said platen and with said pin being adapted to enter between said curved latch portions, (c) and means to bias said catch plates so that said latch portions hold said lock pin in place to lock said platen and said cover means together.

5. The refuse collection vehicle of claim 3 which includes means to automatically unlatch said latch mechanism when said platen moves from said intermediate position toward said fully extended position.

6. The refuse collection vehicle of claim 5 wherein said unlatching means comprises stop means on said frame and engageable by said cover means to prevent further movement of the latter and cause said mechanism to unlatch as said platen continues to move.

7. The refuse collection vehicle of claim 1 wherein said engagement causing means comprises:

(a) second motive means extending between said frame and said cover, (b) and means coordinating said first-named motive means with said second motive means to move said cover means and said platen together when the latter is disposed between said retracted and said intermediate positions.

8. The refuse collection vehicle of claim 7:

(a) wherein said first-named and said second motive means comprise first and second fluid pressure operated cylinders, (b) and wherein said coordinating means comprises means connecting said cylinders fluidically.

9. The refuse collection vehicle of claim 8 wherein the means 1 (g) automatically separates said cover means and said platen when the latter moves from said intermediate position toward said fully extended position.

10. The refuse collection vehicle of claim 9 wherein the stroke of said second cylinder is less than that of said first cylinder and is also commensurate in extent with the distance between said retracted and intermediate positions of said platen, so that said second cylinder reaches its full stroke and stops said cover means when said platen moves beyond said intermediate position.

11. The refuse collection vehicle of claim 1 wherein said engagement causing means comprises means to bias said cover means against said platen when the latter is disposed between said retracted and said intermediate positions.

12. The refuse collection vehicle of claim 11 wherein said biasing means comprises: p1 (a) an arm extending between said frame and said cover, (b) and a spring extending between said frame and said arm.

13. The refuse collection vehicle of claim 12 which includes means to automatically separate said cover means and said platen when the latter moves from said intermediate position toward said fully extended position.

14. The refuse collection vehicle of claim 13 wherein said spring and said arm are positioned so that as said platen reaches said intermediate position, said arm reaches center and stops said cover means as said platen moves beyond said intermediate position.

* * * * *